US006837717B2

(12) United States Patent
Wu et al.

(10) Patent No.: US 6,837,717 B2
(45) Date of Patent: Jan. 4, 2005

(54) COMBINATION STRUCTURE OF SOCKET AND CONTAINER

(75) Inventors: Chih-Chi Wu, Jungli (TW); Wen-Chuan Lo, Jungli (TW); Szu-Lu Huang, Jungli (TW)

(73) Assignee: Delta Electronics, Inc. (TW)

( * ) Notice: Subject to any disclaimer, the term of this patent is extended or adjusted under 35 U.S.C. 154(b) by 0 days.

(21) Appl. No.: 10/615,679

(22) Filed: Jul. 9, 2003

(65) Prior Publication Data

US 2004/0115967 A1 Jun. 17, 2004

(30) Foreign Application Priority Data

Dec. 11, 2002 (TW) ..... 91135889 A

(51) Int. Cl.[7] ..... H01R 12/00
(52) U.S. Cl. ..... 439/57; 439/535; 439/545
(58) Field of Search ..... 439/57, 545–550, 439/535–538

(56) References Cited

U.S. PATENT DOCUMENTS 5,120,231 A * 6/1992 Masumoto ..... 439/76.1
5,984,721 A * 11/1999 Self et al. ..... 439/546
6,540,385 B2 * 4/2003 Ikeda et al. ..... 362/512
6,589,075 B1 * 7/2003 Wu ..... 439/550

* cited by examiner

*Primary Examiner*—Truc T. T. Nguyen
(74) *Attorney, Agent, or Firm*—Volpe and Koenig, P.C.

(57) ABSTRACT

A combination structure of a socket and a container is provided. The combination structure includes a container having an opening, and a socket includes a connecting section for being engaged with the opening, a first end extended from the connecting section for being electrically connected to an electronic equipment which is positioned outside the container, and a second end extended from the connecting section for electrically connecting to a circuit unit which is positioned inside the container, wherein a cross-section of the second end is greater than that of the opening and the cross-section of the opening is greater than that of the first end so that the first end is passed through the opening from an inside of the container and exposed to an outside of the container, and the opening blocks the second end for avoiding the second end passing therethrough and fixing the socket inside the container besides mutually fixing the connecting section.

10 Claims, 8 Drawing Sheets

COMBINATION STRUCTURE OF SOCKET AND CONTAINER

FIELD OF THE INVENTION

This invention relates to a combination structure and method of a socket and a container, and more particular to a combination structure and method of a socket which can be passed through a container from an inner portion thereof to an external portion thereof.

BACKGROUND OF THE INVENTION

Please refer to FIG. 1A which illustrates an assembling schematic view of a socket and a container in the prior art. As shown in FIG. 1, a socket 13 is passed through an opening 101 of a container 10 from the outside thereof. The socket 13 has a fixing portion 130 which is located at an appropriate position thereof. The opening 101 is set at a panel 100 of the container 10. The fixing portion 130 of the socket 13 is integrated with the container 10 through a fixing element 15 (which can be a screw, a rivet, or a bolt). Furthermore, a conducting wire 14 is welded to a solder pad 110 of a circuit board 11 in the container 10.

Thus, in this conventional structure as described above, the electrical connection between the socket 13 and the circuit board 11 must be proceeded after the socket 13 and the container 10 have been fixed together. The manufacturing steps of the conventional structure are described as follows: (1) fixing the circuit board 11 at the container 10; (2) fixing the socket 13 at the container 10; and (3) electrically connecting the socket 13 with the circuit board 11. Among these, the sequences of the steps (1) and (2) can be exchanged to each other and the processes will not be influenced. However, for completing the electrical connection of the socket 13 and the circuit board 11, the operator must pass the tool through a channel of the container 10 which is opposite to the direction of the socket 13 passing through the opening 101 of the container 10. But, the space of the container 10 is limited, especially when the container 10 is a power supply of a computer, the space is extremely narrow. Consequently, the operator must pay much more attention to avoid damaging the electronic elements (not shown) on the circuit board 11 when welding, manufacturing and assembling. Otherwise, in this conventional structure, the socket 13 is not passed through the tin furnace together with the other electronic elements (not shown) on the circuit board 11 but welded separately and artificially. In other words, it needs twice processes, and thus the quality of the finished product will be influenced by the ability and the physical and mental conditions of the operator. Therefore, the defective might be increased which will cause an increase of the cost.

Please refer to FIGS. 1B~1C which illustrate assembling schematic views of a conventional structure. For solving the problem described above, namely increasing the operation space when welding, a working hole 18 (as shown in FIG. 1B) of the container 10 is pre-kept and then sealed after completely welding, or one panel of the container 10 is non-sealed firstly and then sealed after welding. However, both in these two situations, the container 10 can not be a whole case at the first time.

If the assembling method as shown in FIG. 1A is adopted, the electronic elements will easily be damaged during the manufacturing process so that the defective problem is increased. If the assembling methods as shown in FIGS. 1B~1C are adopted, the manufacturing processes will become more complex. Furthermore, because the circuit board 11 is fixed in the container 10 before the conducting wire 14 is welded thereon, the sequential welding processes and checking angles are also limited and will then cause a reduce of the yield. All these are the defects that the conventional structure may produce.

For solving the problems described above, another assembling method is proposed. As shown in FIGS. 2A~2B, a socket a13 is previously and completely welded with a circuit board (not shown) before assembled with a container a 10. A slide trough a130 is set at two sides of the socket a13, so that the container 10 will be assembled with the socket a13 through assembling the slide trough a130 with an edge a100 of an opening a101 on the container a10. Moreover, the opening a101 is always set around one edge of a panel of the container a10 for saving the space. However, as shown in FIG. 2B, it can be seen that if the socket 13 is set at the center of the panel of the container a10, a residue portion a 101' will be formed so as to waste the space and also cause the container a10 to be sealed not hermetically. Please further refer to FIG. 2A, for successfully plugging the socket a13 into the opening a101, a space (not shown) must be pre-kept at a panel (not shown) which is adjacent to the opening a101. After the socket a13 is completely assembled, the space will then be sealed (whose structure is similar to the panel 19 in FIG. 1C). Thus, although the assembling methods illustrated in FIGS. 2A~2B can overcome the disadvantages derived from the welding processes in the prior art (as shown in FIGS. 1A~1C), the container a10 still can not be previously formed as a whole case, and the processes will also become more complex and still need one more step for assembling the case. Consequently, this assembling method still can not simplify the assembling processes of the socket a13 and the container a10.

Because of the technical defects described above, the applicant keeps on carving unflaggingly to develop a "combination structure of socket and container" through wholehearted experience and research which.

SUMMARY OF THE INVENTION

It is an object of the present invention to provide a socket structure which can be passed through a container from the inner portion thereof and then be fixed.

It is another object of the present invention to provide a socket which can be pre-welded with a circuit board before assembling, namely after connecting the socket with the circuit board, the socket is then connected to the container, for simplifying the fabricating processes, increasing the assembling efficiency, and improving the yield rate.

In accordance with an aspect of the present invention, a combination structure of a socket and a container includes a container having an opening, and a socket including a connecting section for being engaged with the opening, a first end extended from the connecting section for being electrically connected to an electronic equipment which is positioned outside the container, and a second end extended from the connecting section for electrically connecting to a circuit unit which is positioned inside the container, wherein a cross-section of the second end is greater than that of the opening and the cross-section of the opening is greater than that of the first end so that the first end is passed through the opening from an inside of the container and exposed to an outside of the container, and the opening blocks the second end for avoiding the second end passing therethrough and fixing the socket inside the container besides mutually fixing the connecting section.

Preferably, the connecting section and the container are locked together via a lock-in way.

Preferably, the connecting section further includes a first hook and the container further includes a second hook in which the first hook and the second hook are locked to each other.

Preferably, the connecting section includes a screw thread for rotating into the opening.

Preferably, the connecting section and the opening are engaged via a bayonet.

Preferably, the connecting section and the container are fixed together via a bolt.

Preferably, the connecting section and the container are fixed together via a rivet.

Preferably, the container is a case of a power supply.

Preferably, the circuit unit is a circuit board.

In accordance with another aspect of the present invention, a combination structure of a socket and a container includes a container including a faceplate having an opening thereon and a socket being set in the container including a connecting section for being engaged with the opening, a first end extended from the connecting section for being electrically connected to an electronic equipment which is positioned outside the container, and a second end extended from the connecting section for being electrically connected to a circuit unit which is positioned inside the container, wherein a cross-section of the opening is greater than that of the first end so that the first end is passed through the opening from an inside of the container and exposed to an outside of the container, and the opening blocks the second end for avoiding the second end passing therethrough and fixing the socket inside the container besides mutually fixing the connecting section.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 3A:
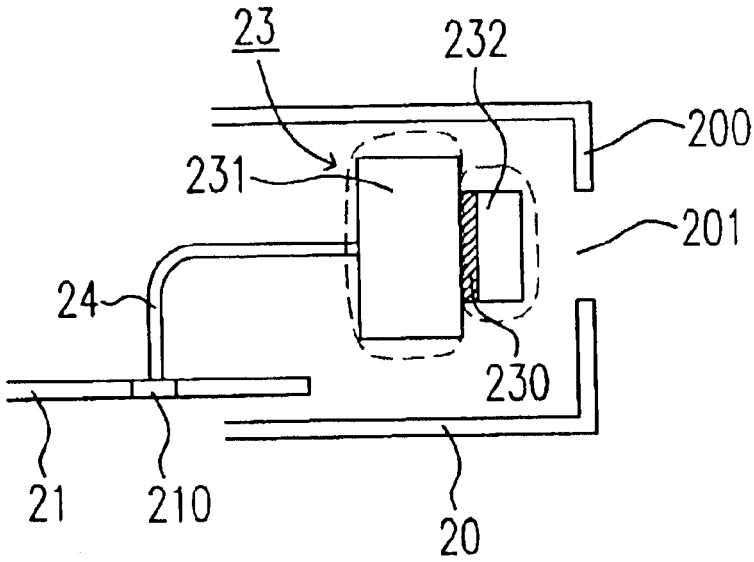
FIGS. 3A~3B show the assembling and structural schematic views of the socket in the first preferred embodiment according to the present invention.
Figure 3B:
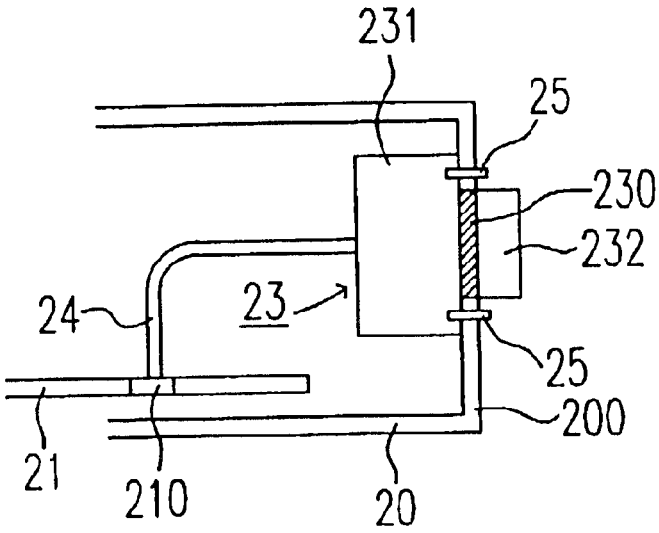

Please refer to FIGS. 3A~3B which illustrate the assembling and structural schematic views of the socket in the first embodiment according to the present invention. As shown in FIGS. 3A~3B, a socket 23 includes a connecting section 230, a first end 232 which is connected to the front end of the connecting section 230, and a second end 231 which is connected to the back end of the connecting section 230. When assembling the socket 23 with a container 20, firstly the socket 23 is electrically connected to a circuit board 21 through conducting an electric wire 24 and a solder pad 210. After the socket 23 is connected to the circuit board 21, the circuit board 21 together with the socket 23 are put into the container 20 and the first end 232 of the socket 23 will be passed through an opening 201 of the container 20, so that the connecting section 230 of the socket 23 will be blocked against a panel 200 which is adjacent to the opening 201. Finally, the socket 23 and the container 20 are fixed together through a fixing element 25 (which can be a screw, a rivet, or a bolt, as shown in FIG. 3B). In this embodiment, the fixing element 25 will be passed through the panel 200 to integrate with the connecting section 230 of the socket 23 for fixing the socket 23 on the container 20. Because the cross section area of the opening 201 is only slightly larger than that of the first end 232 and smaller than that of the second end 231, the socket 23 will be blocked by the second end 231 when assembling. Consequently, the socket 23 can stay close to the panel 200 without passing through the container 20 and the second end 231 can remain inside the container 20.

As it can be seen in FIGS. 3A~3B, the cross section area of the second end 231 is larger than that of the opening 201, so that when assembling the socket 23, the operator only needs to simply pass the fist end 232 through the container 20 from the inside thereof to block tightly against the container 20 and continuously fix the socket 23 and the container 20 via the fixing element 25, so that the assembling processes can be finished.

Moreover, for more effective and easily assembling the socket, the present invention can further include a set of fixing devices separately set on the socket 23 and the container 20. With this set of fixing devices, the fixing element 25 as shown in FIG. 3 will not be needed any more, and the operator only need to process a translation or a rotation and the socket 23 can be fixed on the container 20.

Figure 4:
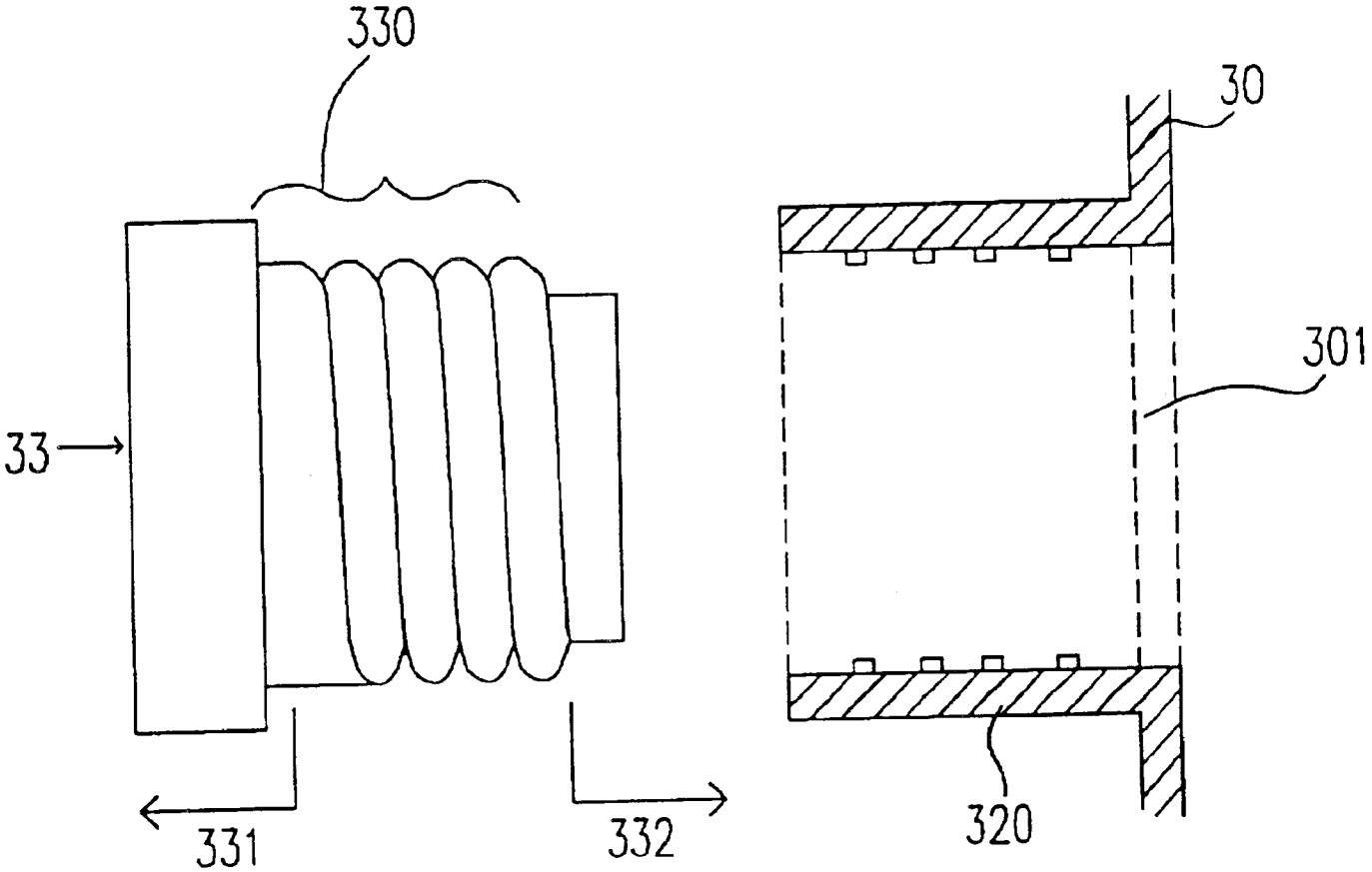
FIG. 4 shows the assembling and structural schematic view of the socket in the second preferred embodiment according to the present invention.

As shown in FIG. 4 which illustrates the assembling and structural schematic view in the second embodiment according to the present invention, a female thread is set at an inner surface of a surrounding structure 320 of an opening 301 on a container 30 and a male screw is set on a connecting section 330 of a socket 33. The surrounding structure 320 and the connecting section 330 are the fixing devices which can mutually integrate to each other. In this situation, the assembling steps are (as described above): electrically connecting a circuit board (not shown, please refer to FIG. 3) to the socket 33; putting the socket 33 with the circuit board into the container 30 and passing a first end 332 of the socket 33 through the opening 301; and rotating the socket 33 into the surrounding structure 320 for fixing to each other via a screw way so as to complete the assembling.

Compared with the embodiment described in FIG. 3, the one illustrated in FIG. 4 lacks of the fixing element 25 (as shown in FIG. 3) but sets the female thread inside the surrounding structure 320 of the opening 301 and the male screw on the connecting section 330 of the socket 33. According to this structure, the operator only needs to rotate the socket 33 after passing the first end through the opening 301 and the socket 33 and the container 30 can be fixed to each other well. Furthermore, for avoiding the circles of the rotation being too many, the screw and thread can be formed to have a multi-stage structure, so that the socket 33 only need to be rotated a small angle for fixing the socket 33 and the container 30.

Figure 5A:
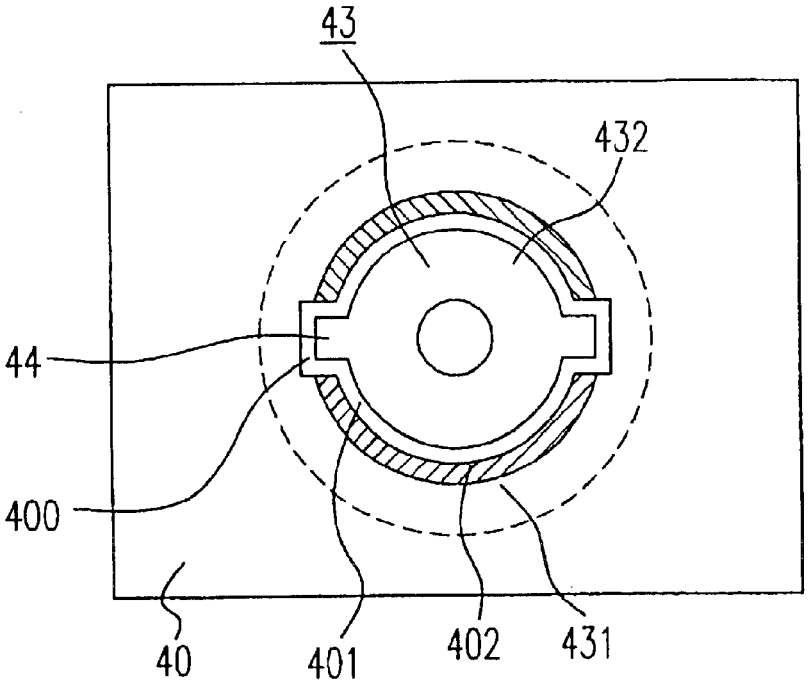
FIGS. 5A~5C show the assembling and structural schematic views of the socket in the third preferred embodiment according to the present invention.
Figure 5B:
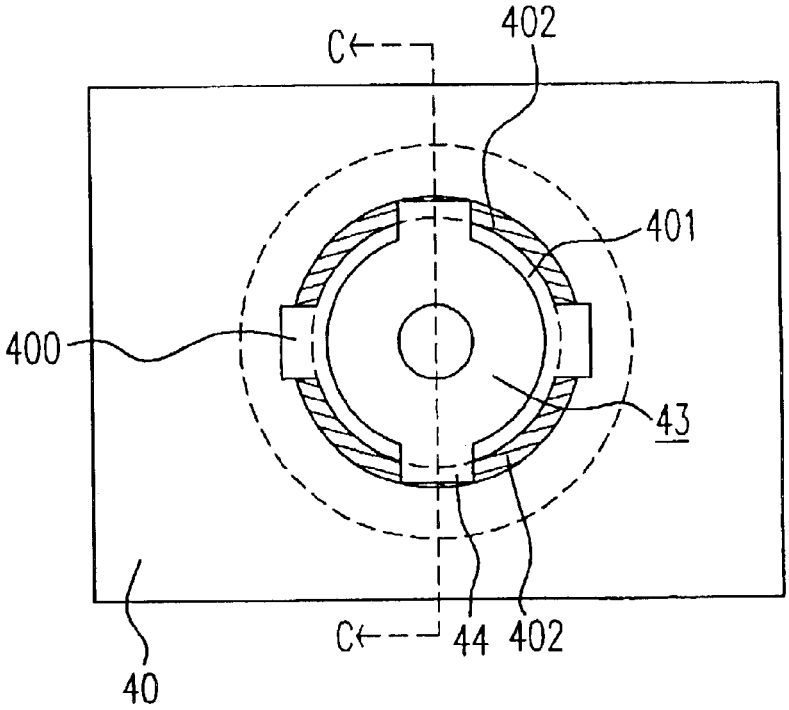

Please refer to FIGS. 5A~5B which illustrate the assembling and structural schematic views in the third embodiment according to the present invention. For more effectively assembling a socket 43 and a container 40 and reducing the cost of assembling, the socket 43 can further include a lug 44 and the surrounding 402 of an opening 401 can further include a notch 400. When a first end 432 of the socket 43 is passed through the opening 401 of the container 40, the lug 44 is simultaneously passed though the notch 400 (as shown in FIG. 5A). Then, the lug 44 is rotated to mutually block the surrounding 402 of the opening 401 (as shown in FIG. 5B). Because the cross section area of the second end 431 (as shown in FIG. 5C) is larger than that of the opening 401, when the second end 431 which owns larger cross section is blocked against the surrounding 402 of the opening 401, the operator can easily notice that the socket 43 can not be passed through the opening 401 any more and then the operator can rotate the socket 43 to diverge the lug 44 from the notch 400.

Please again refer to FIG. 5C which shows the sectional drawing of the hatch C in FIG. 5B. It is clear that the lug 44 is rejected by the surrounding 402 and the second end 431 is blocked against the container 40, and thus the socket 43 can be stably fixed on the container 40.

Figure 5C:
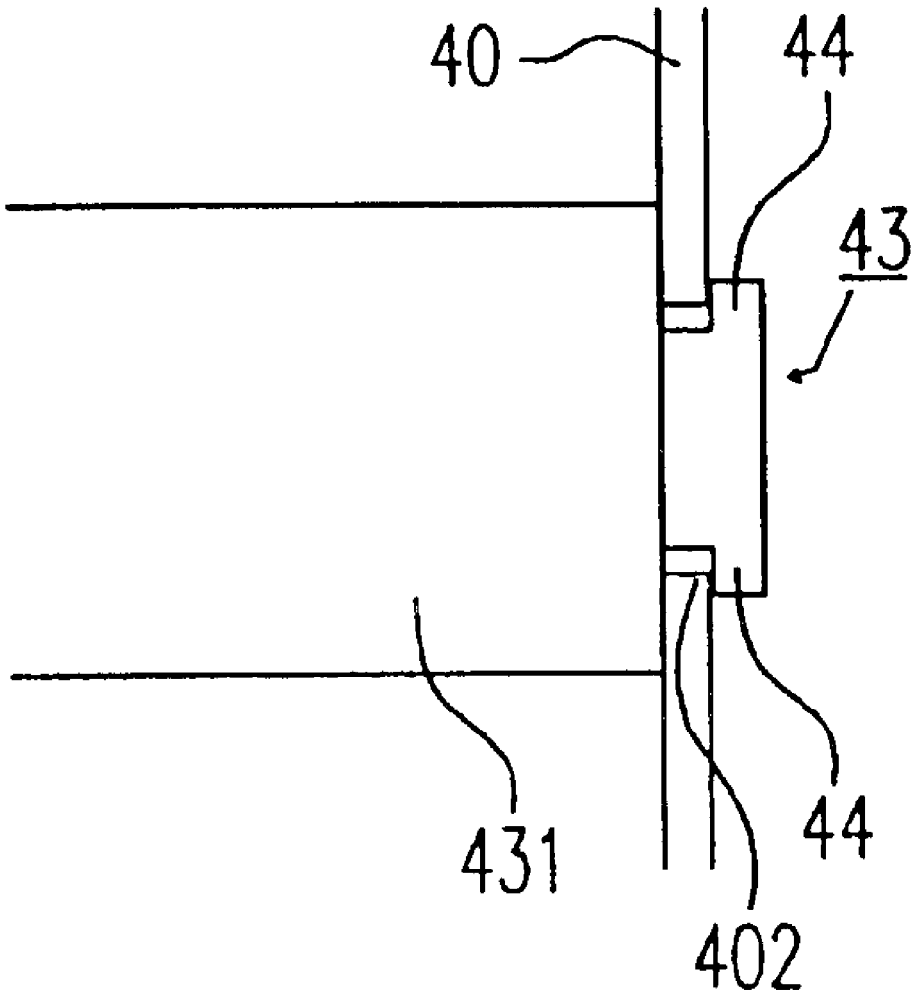

As shown in FIGS. 5A~5C, this combination method called bayonet can effectively simplify the combination process between the socket 43 and the container 40. Therefore, when assembling, the operator only needs to pass the first end 432 through the opening 401 and rotates the socket for diverging the lug 44 from the notch 400 and rejecting the lug 44 against the surrounding 402 of the opening 401, and the socket 43 can be fixed on the container 40. The surrounding 402 of the opening 401 stops the lug 44, so that the socket 43 will not go back into the container 40. In addition, the manufacturing of the lug 44 is easier than that of the screw of the connecting section 330 (as shown in FIG. 4). The notch 400 can be formed together with the formation of the opening 401 which is generally made by a punching method, and, of course, this is easier than forming a thread on the inner surface of the surrounding structure 320 of the opening 301 (as shown in FIG. 4). Compared to the embodiment described in FIGS. 3A~3B, the one illustrated in FIG. 5 lacks the fixing element 25, so that the assembling time will become shorter, an error which might be produced in integrating the fixing element 25 can be reduced, and the yield rate can also be increased.

Figure 6A:
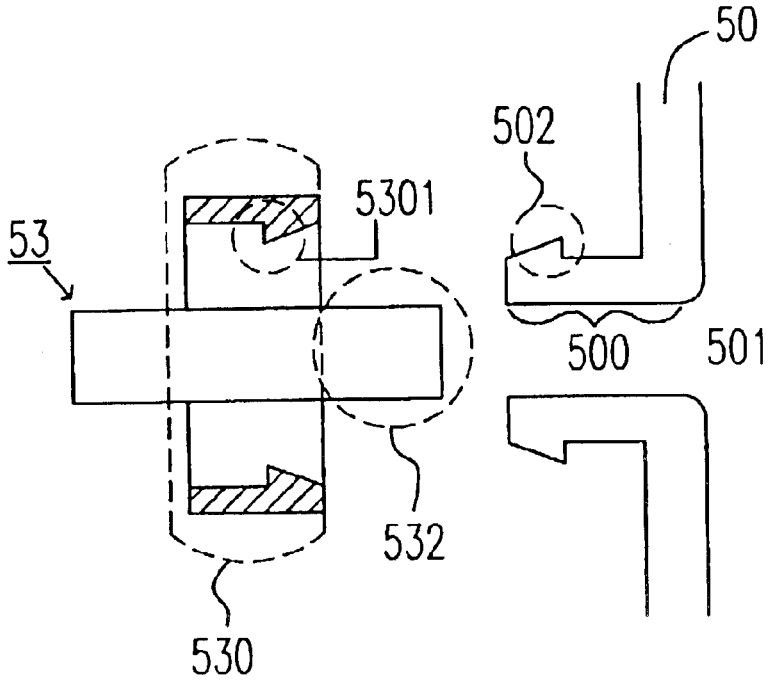
FIGS. 6A~6B show the assembling schematic views of the lock-in way of the socket in the fourth preferred embodiment according to the present invention.
Figure 6B:
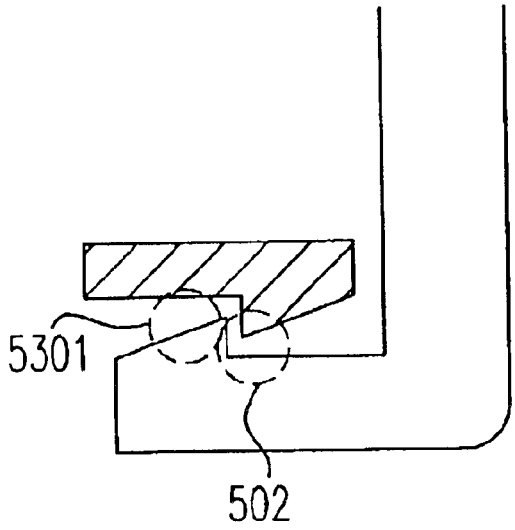

Please refer to FIG. 6A which illustrates the assembling schematic views of the lock-in way of the socket in the fourth preferred embodiment according to the present invention. As shown in FIG. 6A, a socket 53 includes a first hook 5301 set at a connecting section 530 thereof and a container 50 includes a second hook 502 set on a receiving portion 500 thereof. When a first end 532 is passed through the opening 501, the first hook 5301 will lock with the second hook 502 (as shown in FIG. 6B) so as to guarantee that the socket 53 will not go back into the container 50.

Certainly, the locking method described above can be achieved through another way and will not be limited. Besides, another significant character of this method is that a notch (as shown in FIGS. 5A~5B) will not be left on the appearance, and because it does not need the additional fixing element (as shown in FIG. 3), a screw or a nut will not be left outside the container 50. Consequently, the container 50 will own a succinct and smooth appearance under this condition.

Figure 1A:
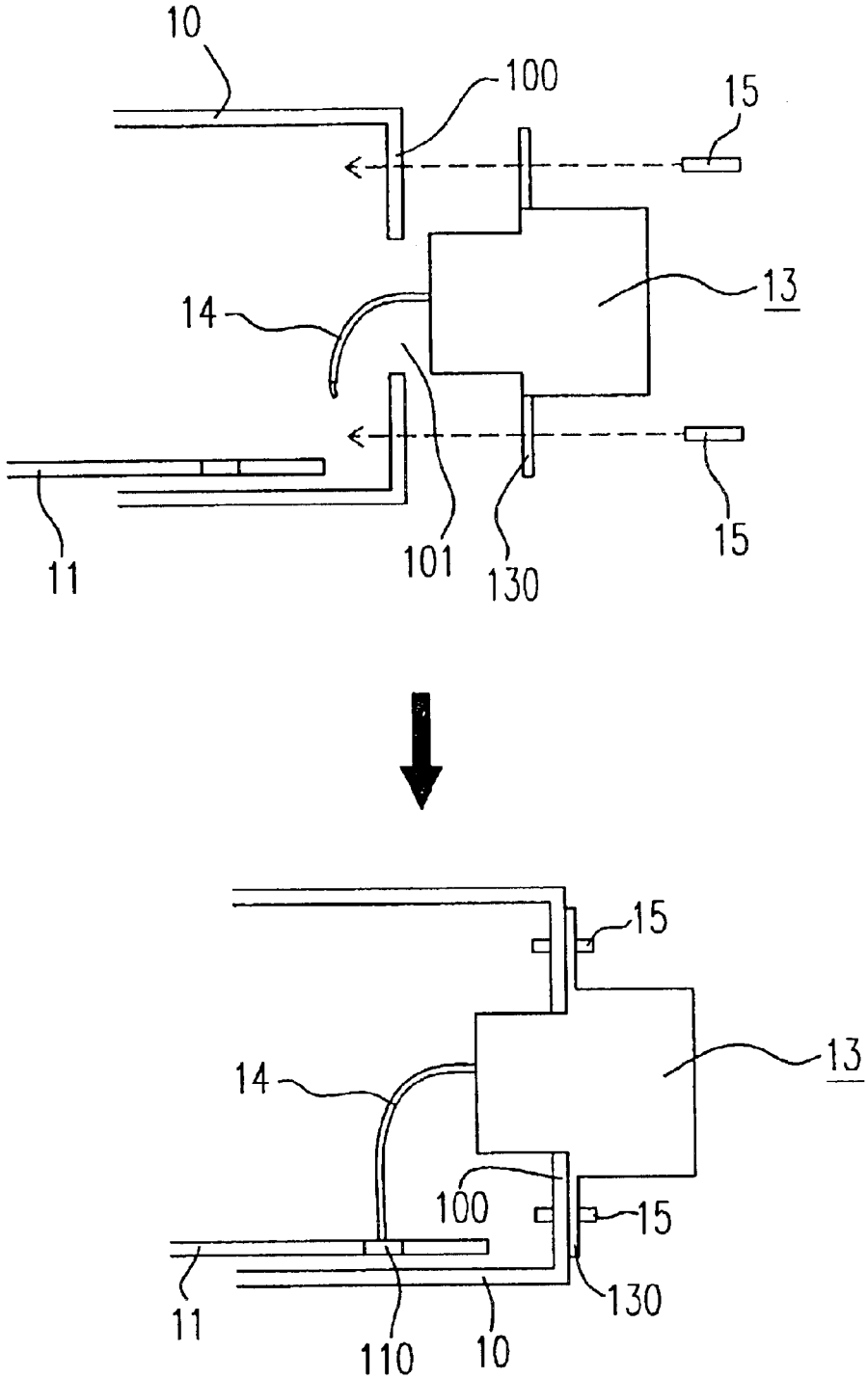
Fig. 1(a) (PRIOR ART)
FIGS. 1A~1C show the assembling schematic views of the socket in the prior art.
Figure 1B:
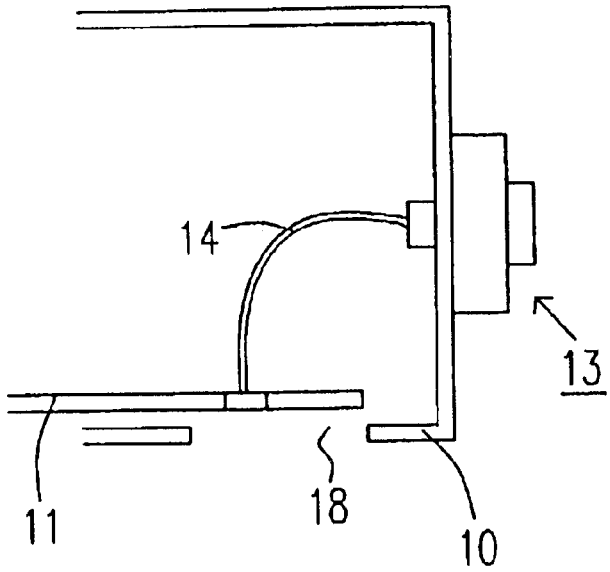
Fig. 1(b) (PRIOR ART)
Figure 1C:
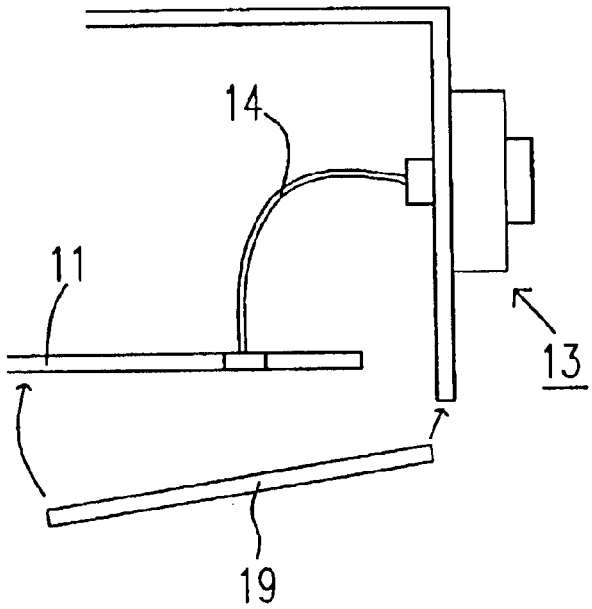
Fig. 1(c) (PRIOR ART)
Figure 2A:
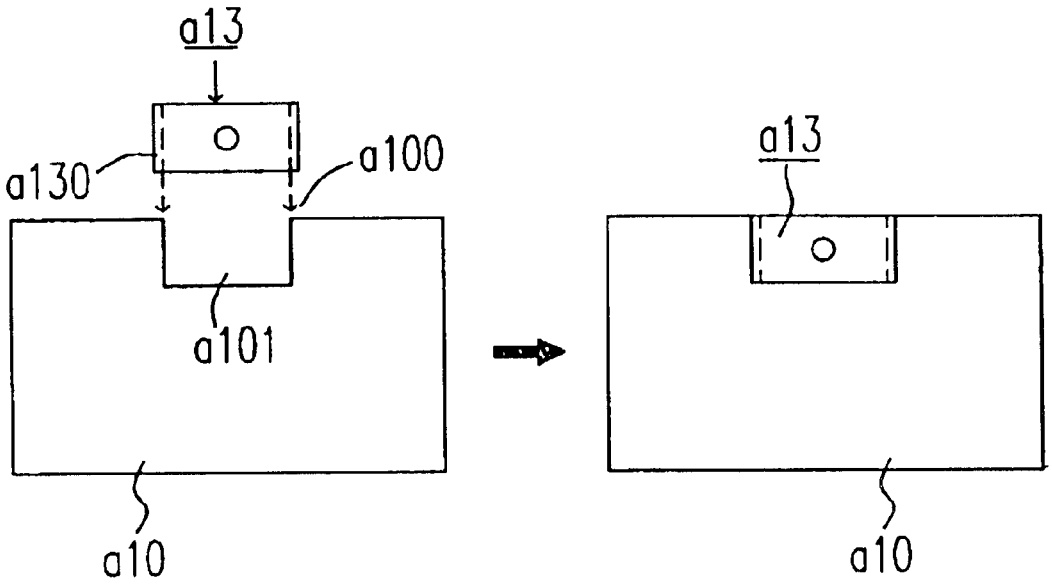
Fig. 2(a)(PRIOR ART)
FIGS. 2A~2B show the assembling schematic views of another socket in the prior art.
Figure 2B:
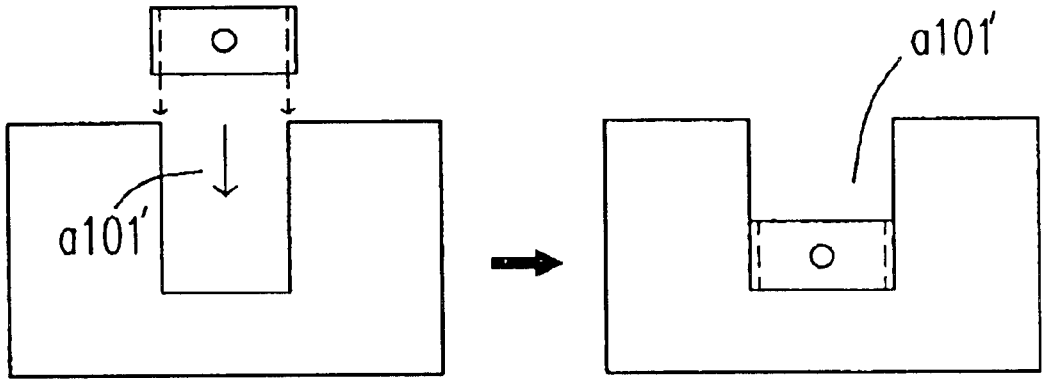
Fig. 2(b)(PRIOR ART)

The characters of the present invention can be easily recognized through the embodiments described in FIGS. 3~6. Take FIG. 3 as an example. When assembling the socket 23 and the container 20, the socket 23 can be previously connected with the circuit board 21 (e.g., the circuit board in the power supply apparatus), the socket 23 and the circuit board 21 can be simultaneously put into the container 20, and then the first end 232 of the socket 23 is passed through the opening 201 and the socket 23 and the container 20 will block each other. In one word, the socket according to the present invention is passed through the container from the inside thereof and is previously connected to some electronic elements which will be positioned inside the container. Oppositely, in the prior art, as shown in FIGS. 1A~1C, the socket 13 is connected with the container 10 from the outside thereof and then fixed (e.g., fixing element 15). Thus, the connecting processes between the socket 13 and the circuit board 11 must be completed in the extremely narrow space inside the container 10 which will cause the increase of the manufacturing processes and also the artificial cost.

If the socket structure of the present invention is adopted, as shown in FIG. 3, the socket 23 can be connected to the circuit board 21 before being connected to the container 20. Therefore, the assembling processes are simplified. And, it is obvious that the welding of the circuit 21 and the socket 23 outside the container 20 will be easier than inside thereof. Namely, all electronic elements and the socket 23 are plugged on the circuit board 21 at the same time and are also passed through the tin furnace together, so that it only needs one time of tin solder. Compared with FIG. 1, the prior art processes the first welding of welding the electronic elements on the circuit board 11 when passing through the tin furnace and the second welding of welding the conducting wire 14 on the circuit board 11 after the circuit board 11 is set inside the container 10. Therefore, the prior art needs one more welding process than the present invention, namely one more chance to produce an error. Moreover, because the socket in the present invention can be passed through the tin furnace and plugged in the circuit board together with other electronic elements, it can avoid an artificial carelessness which might be occurred in the prior art. Furthermore, in the prior art, when welding the conducting wire 14 on the circuit board 11, except the common problem of different sizes of the welding beads when artificially welding, there will also be some additional beads drop on the circuit board 11 which might cause the short circuit or damage the circuit board 11. And it will also be inconvenient to clean up the dropped beads which will delay the manufacturing processes, increase the cost, and also delay the time of exporting the product. In conclusion, the troubles caused by the conventional structure will seriously influence the whole working of the manufacturer.

Furthermore, the embodiments illustrated in FIGS. 4~6 are set the thread of the screw on the socket 33 (as shown in FIG. 4), set the lug 44, 54 on the socket 43, 53 (as shown in FIG. 5), or employ a lock-in way (as shown in FIG. 6) to connect to the container 30, 40, and 50 and are more effective than utilizing the fixing element 15, 25. Because the step of integrating the fixing element will therefore be saved, the operation error will also be avoided at the same time. Thus, to be compared with the prior art, the present invention is more practical, more effective, simpler and easier for operating. And, most importantly, the present invention avoids the welding process inside the container which will easily cause an error. Consequently, the present invention is more progressive than the prior art.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A combination structure of a socket and a container, comprising:

a container having an opening; and a socket, comprising:

a connecting section for being engaged with said opening;

a first end extended from said connecting section for being electrically connected to an electronic equipment which is positioned outside said container; and a second end extended from said connecting section for electrically connecting to a circuit unit which is positioned inside said container, wherein a cross-section of said second end is greater than that of said opening and said cross-section of said opening is greater than that of said first end so that said first end is passed through said opening from an inside of said container and exposed to an outside of said container, and said opening blocks said second end, for avoiding said second end passing therethrough and fixing said socket inside said container besides mutually fixing said connecting section.

2. The combination structure according to claim 1, wherein said connecting section and said container are locked together via a lock-in way.

3. The combination structure according to claim 1, wherein said connecting section further comprises a first hook and said container further comprises a second hook in which said first hook and said second hook are locked to each other.

4. The combination structure according to claim 1, wherein said connecting section comprises a screw thread for rotating into said opening.

5. The combination structure according to claim 1, wherein said connecting section and said opening are engaged via a bayonet.

6. The combination structure according to claim 1, wherein said connecting section and said container are fixed together via a bolt.

7. The combination structure according to claim 1, wherein said connecting section and said container are fixed together via a rivet.

8. The combination structure according to claim 1, wherein said container is a case of a power supply.

9. The combination structure according to claim 1, wherein said circuit unit is a circuit board.

10. A combination structure of a socket and a container, comprising:

a container comprising a faceplate having an opening thereon; and a socket being set in said container, comprising:

a connecting section for being engaged with said opening;

a first end extended from said connecting section for being electrically connected to an electronic equipment which is positioned outside said container; and a second end extended from said connecting section for being electrically connected to a circuit unit which is positioned inside said container, wherein a cross-section of said opening is greater than that of said first end so that said first end is passed through said opening from an inside of said container and exposed to an outside of said container, and said opening blocks said second end for avoiding said second end passing therethrough and fixing said socket inside said container besides mutually fixing said connecting section.

* * * * *